US009877527B1

(12) United States Patent
Marshall

(10) Patent No.: US 9,877,527 B1
(45) Date of Patent: Jan. 30, 2018

(54) INTERACTIVE SHIRT

(71) Applicant: Willie David Marshall, Winston-Salem, NC (US)

(72) Inventor: Willie David Marshall, Winston-Salem, NC (US)

( * ) Notice: Subject to any disclaimer, the term of this patent is extended or adjusted under 35 U.S.C. 154(b) by 55 days.

(21) Appl. No.: 14/504,869

(22) Filed: Oct. 2, 2014

(51) Int. Cl.

| | |
|---|---|
| ***A41D 27/20*** | (2006.01) |
| ***A41D 15/04*** | (2006.01) |
| ***A41D 27/08*** | (2006.01) |
| ***A63B 63/08*** | (2006.01) |

(52) U.S. Cl.
CPC ..... *A41D 15/04* (2013.01); *A41D 27/08* (2013.01); *A41D 27/201* (2013.01); *A63B 63/083* (2013.01)

(58) Field of Classification Search
CPC .... A41D 13/0015; A41D 15/04; A41D 27/08; A41D 27/201
See application file for complete search history.

(56) References Cited

U.S. PATENT DOCUMENTS

| | | | | | |
|---|---|---|---|---|---|
| 3,752,477 | A | * | 8/1973 | Hoyt | 473/488 |
| 4,274,639 | A | * | 6/1981 | Flanders | 273/402 |
| D275,717 | S | * | 10/1984 | Carr | D3/257 |
| 4,723,323 | A | * | 2/1988 | Wright, Jr. | 2/48 |
| 5,222,259 | A | * | 6/1993 | Bristor | 2/115 |
| 5,394,565 | A | * | 3/1995 | Stewart | A41D 11/00 2/108 |
| 5,413,328 | A | * | 5/1995 | Glancey et al. | 473/439 |
| 5,526,535 | A | * | 6/1996 | Dobrzenski | A41D 13/0012 2/102 |
| 5,815,841 | A | * | 10/1998 | Spangrud | 2/195.1 |
| D401,035 | S | * | 11/1998 | Robinson | D2/830 |
| D517,782 | S | * | 3/2006 | Hunter | D2/886 |
| 7,374,503 | B2 | * | 5/2008 | Mullins | 473/479 |
| 8,234,721 | B1 | * | 8/2012 | Cestare et al. | 2/171.1 |
| 2015/0359269 | A1 | * | 12/2015 | Rapp | A41D 1/02 2/93 |

* cited by examiner

*Primary Examiner* — Shaun R Hurley
*Assistant Examiner* — Andrew W Sutton
(74) *Attorney, Agent, or Firm* — Ben Schroeder Law PLLC

(57) ABSTRACT

The true player interactive wear collection center pocket is a shirt like design invention to help people to Have a Hands free support storage interactive center pocket that is sewn and zipper open and close on to the center of the shirt. Different size pockets alone with the logo are sewn and attached using velcro on the inside of the Interactive wear collection center pocket to help store and carry items and other things. Like cellphone car key ID and other personal items. And will carry inflatable basketball games and other Inflatable items that are attached with velcro inside of the interactive wear collection center pocket. The logo Initially Yours Fashion Inc. True Player Interactive Wear Collection will be print and embroidered on shirts, pants, shorts. Shoes, jackets, hats, skirts and other marketing promotions items. The interactive center pocket was invented for hands free help and for storing items.

16 Claims, 17 Drawing Sheets

INTERACTIVE SHIRT

FIELD OF THE INVENTION

The present invention relates to a method of manufacturing an apparel, in a shirt like design, using varies types of fabrics and materials. This shirt will have a variety of applications and was first designed to hold interactive games and is part of a fashion collection. One of the primary applications is an inflatable basketball game. The collection will also include an interchangeable storage pockets.

BACKGROUND

There are disadvantages of carrying bulky handbags, backpacks or other types of totes and fanny packs. It would be desirable if items that are normally carried in bulky handbags, backpacks or other types of totes and fanny packs could be incorporated into one's apparel that one is currently wearing, thus providing a secure but convenient placement of these items, while leaving one's hands free.

SUMMARY OF THE INVENTION

This present invention overcomes the disadvantages of carrying a bulky handbags backpacks or other type of totes and fanny packs. With this invention these items can be incorporated into one's apparel that one is currently wearing, thus providing a secure but convenient placement of items, while leaving one's hands free.

In an embodiment, the apparel is a shirt.

In an embodiment, these shirts were invented for the purpose of a way to attach, support and store the inflatable basketball game. The interactive center pocket was primarily designed to support the inflatable backboard for the basketball goal and net. With the game fully inflated, it is now ready to be played. With the storage flap closed, the entire basketball backboard, goal, net and ball will self store. Further along in the devolvement of the design of the interactive center pocket, the design was expanded to allow the basketball game to be removed in order to be interchanged with other interactive storage pockets and games. The design includes Interchangeable storage pockets, which will store a variety of items normally held with a person's hands, such as cell phones, wallet, car keys, eye glasses and make up. This storage pocket can also be used as a method to carry items while giving the person that is wearing it the opportunity to have hands free. The hands free method on this interchangeable storage pocket will consist of various pockets ranging in different sizes and shapes. The storage pockets will be attached in the interactive center pocket on the shirt.

The shirt design will include various pockets placed throughout the shirts and other designs that are part of the collections, such as matching pants, shorts, shoes, jacket, hats, skirts and other marketing promotions.

DETAILED DESCRIPTION

Figure 1:
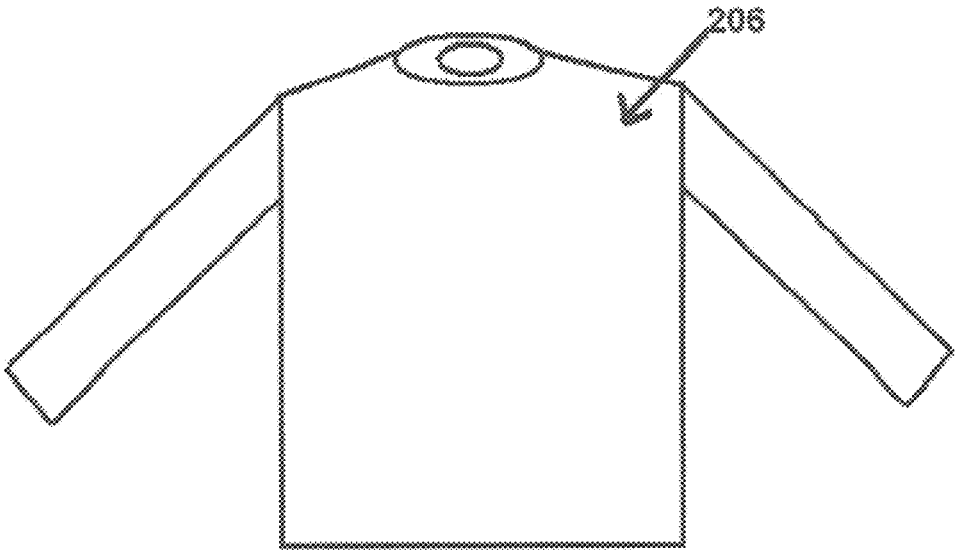
FIG. 1 shows a shirt prior to applying the interactive pocket is applied

The invention is described in detail using drawings in which an example shirt is explained in the drawings.

FIG. 1 is a view of the shirt 206, before the interactive center pocket 207, is applied.

Figure 2:
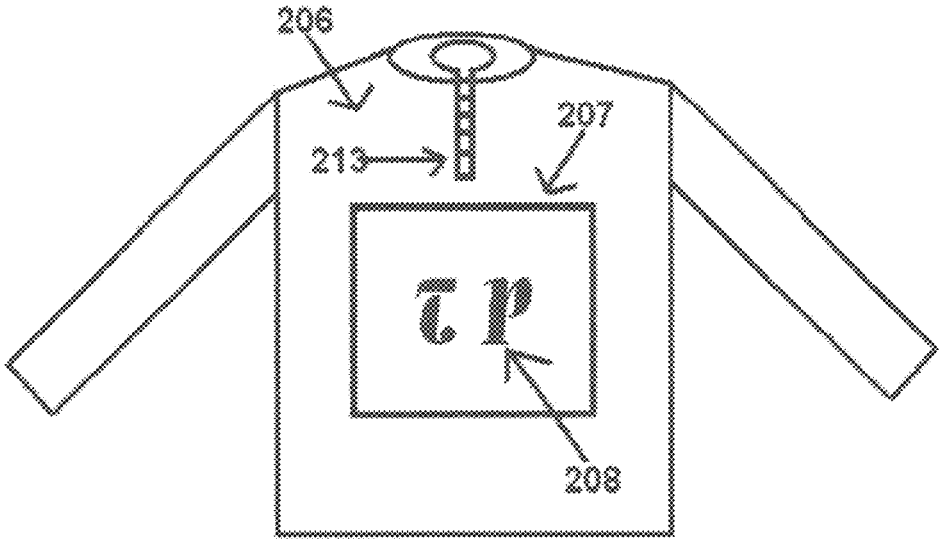
FIG. 2 shows a front view of the shirt with a logo.
Figure 3:
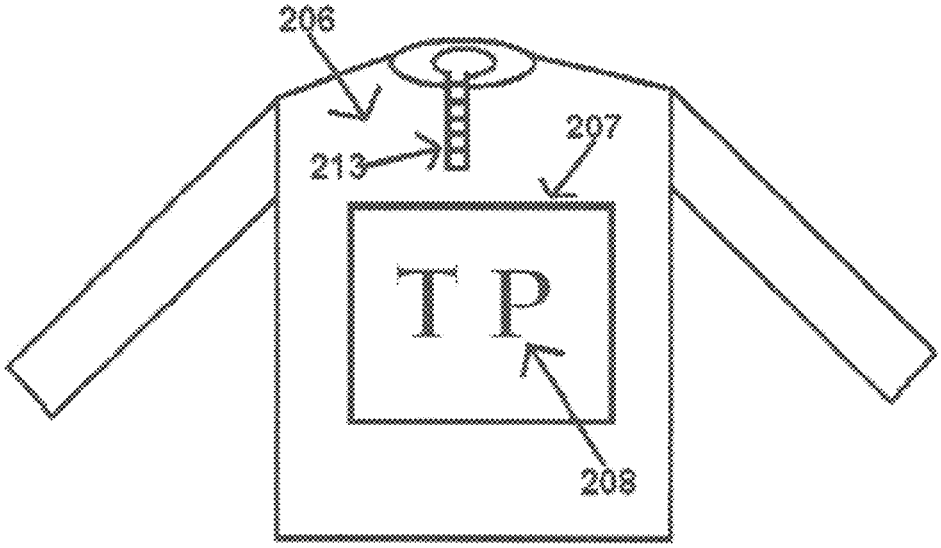
FIG. 3 shows a front view of the shirt with a different logo.

FIG. 2 and FIG. 3 are views of the shirts 206, with the interactive center pocket 207, zipper neck 213, and Logo 208.

Figure 4:
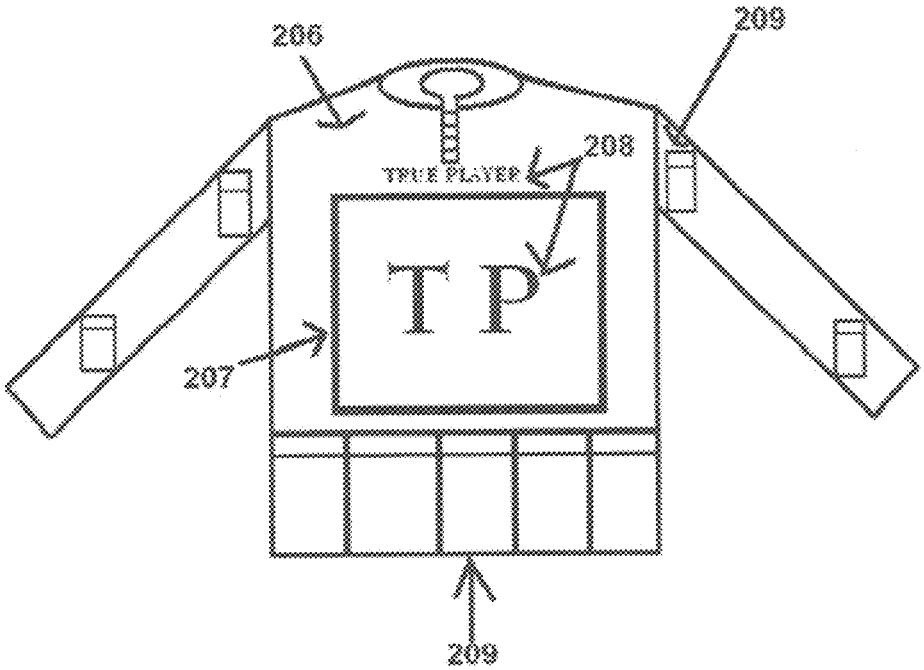
FIG. 4 shows a shirt with a plurality of interactive pockets.
Figure 5:
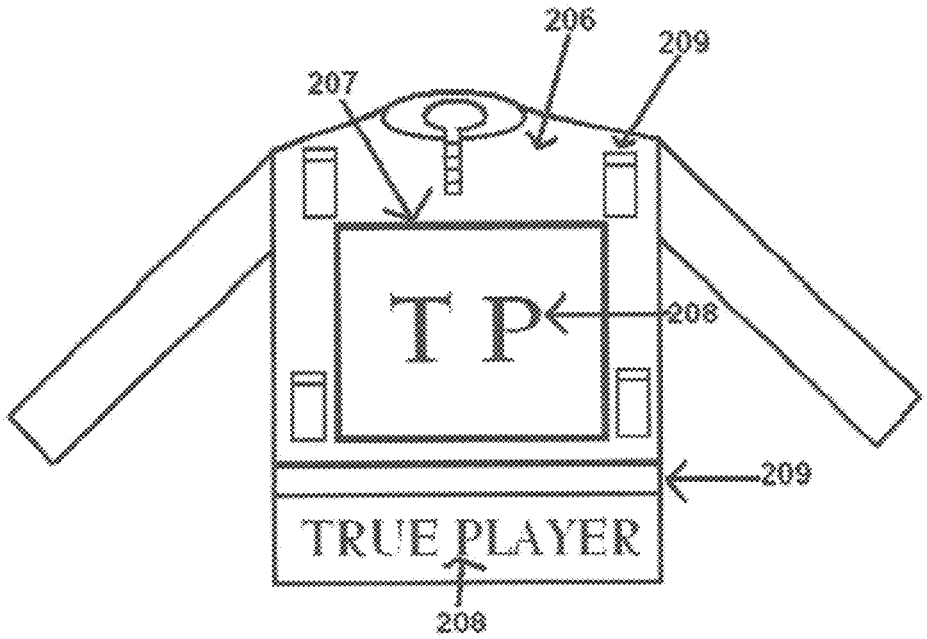
FIG. 5 shows another embodiment of a shirt with a plurality of interactive pockets.

FIG. 4 and FIG. 5 are views of the two shirts 206: FIG. 4 shows a shirt 206, with a variety of pockets 209, on both the bottom of the shirt and on the sleeves. The True Player Logo 208, is on the center pocket as well as on the shirt 206, above the center pocket 207. FIG. 5 shows a shirt 206, with a long single pocket 209, across the bottom of the shirt 206, with smaller pockets 209, around the center interactive pocket 207. The True Player Logo 208, is on the center interactive pocket 207 and the single pocket on the bottom.

Figure 6:
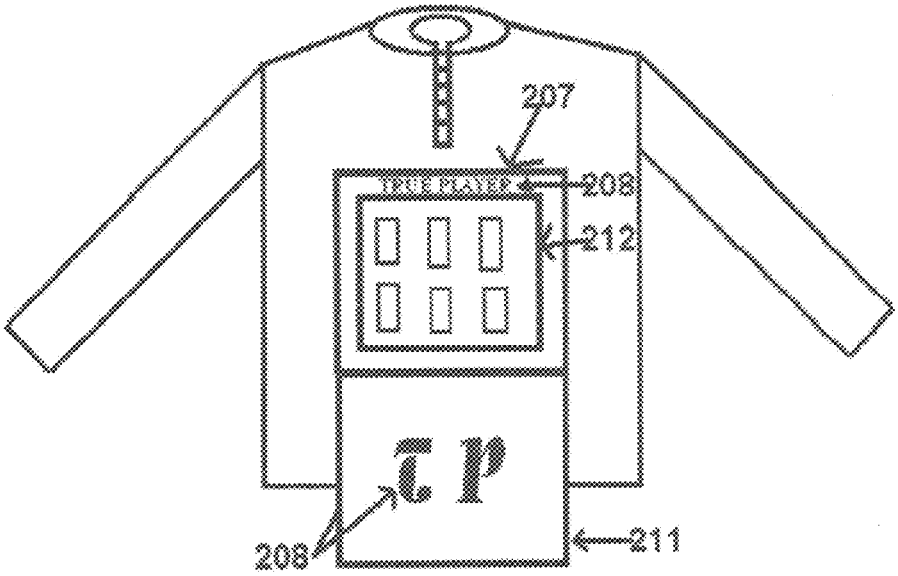
FIG. 6 shows a front view of the shirt with an interchangeable pocket in the open position.
Figure 7:
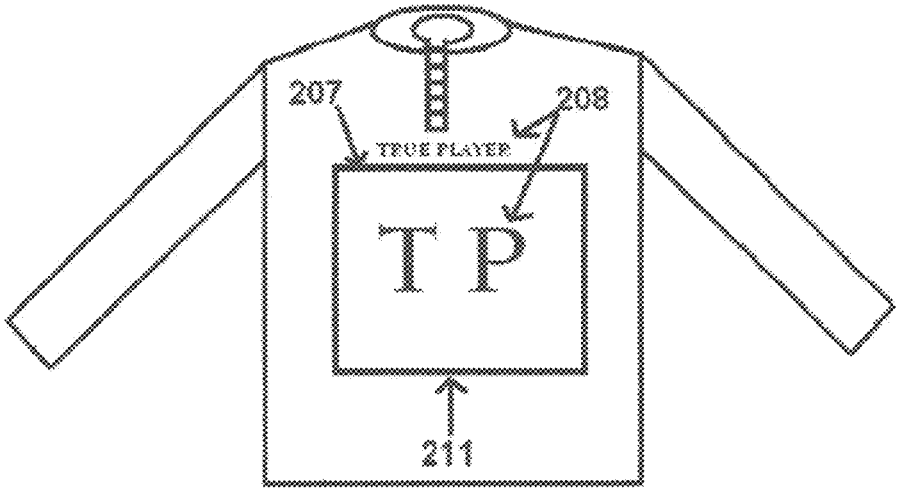
FIG. 7 shows a front view of the shirt with an interchangeable pocket in the closed position.

FIG. 6 and FIG. 7 are views of two shirts 206:

FIG. 6 shows the center interactive pocket 207, with the interchangeable storage pockets 212, installed inside, with the center interactive flap 211, in the open position with the logo 208, on the flap, front and back, as well as inside of the interactive pocket.

FIG. 7 shows the center interactive flap 211, in the closed position with the logo 208, on the flap 211 and over the center interactive pocket 207.

Figure 8:
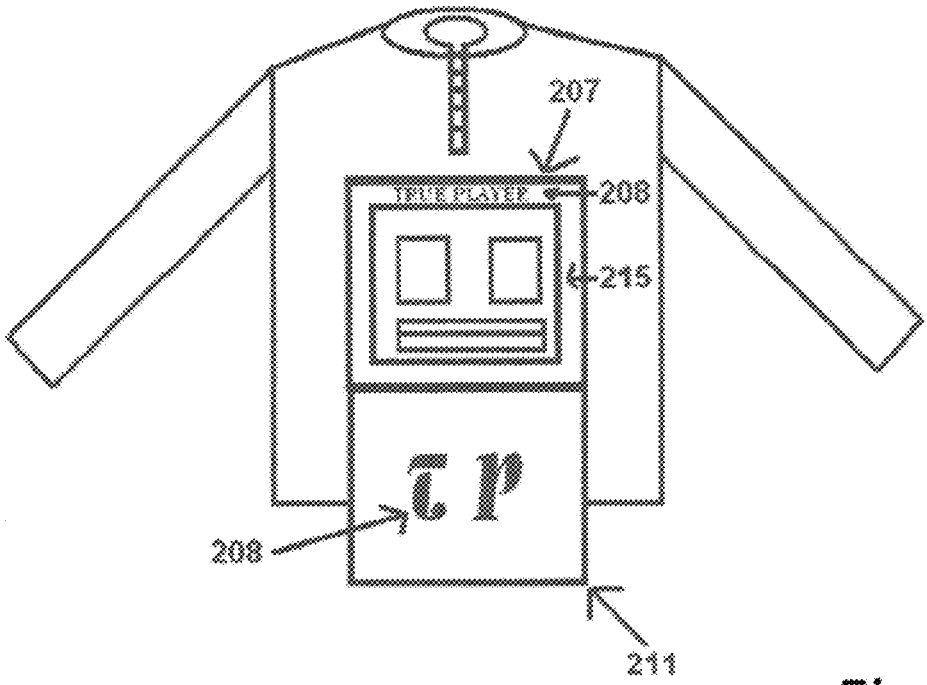
FIG. 8 shows a front view of the shirt with an interchangeable pocket in the open position with interchangeable pockets in the interchangeable pocket.
Figure 9:
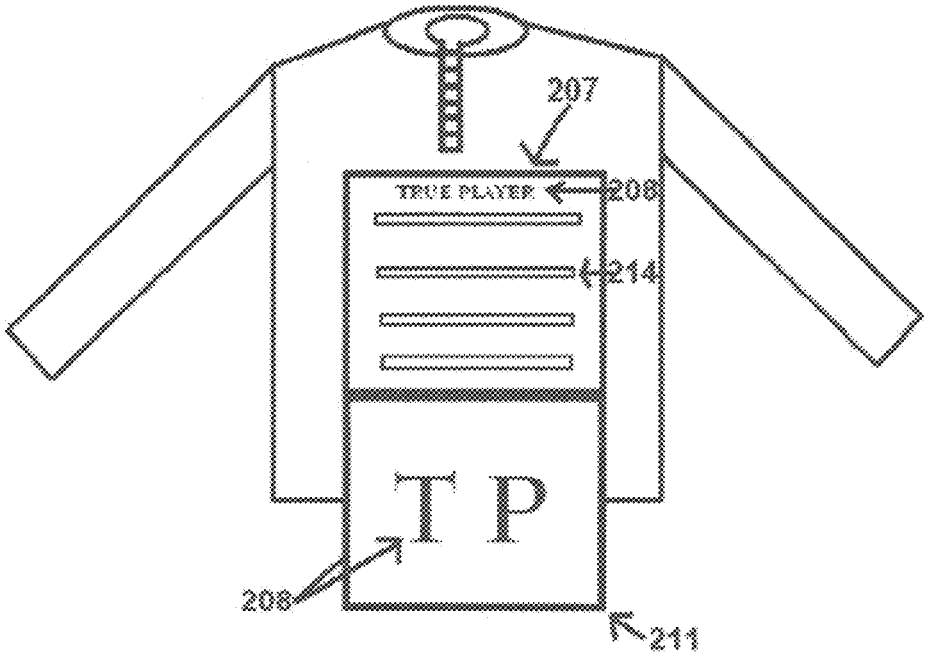
FIG. 9 shows a front view of the shirt with an interchangeable pocket in the open position with horizontal hook and loop strips.

FIG. 8 AND FIG. 9 show a view of two shirts 206: FIG. 8 shows the center interactive pocket 207, with another interchangeable storage pockets 215, installed inside, with the center interactive flap 211, in the open position with the logo 208, on the flap. FIG. 9 shows the Velcro® (Manchester, N.H.) (i.e., hook and loop fastener) support strips 214, applied in the center interactive pocket 207, used to hold the games and storage pockets in place. The center interactive flap 211, is in the open position with the logo 208, also visible from the reverse side of the flap 211, as well as inside of the interactive pocket 207.

Figure 10:
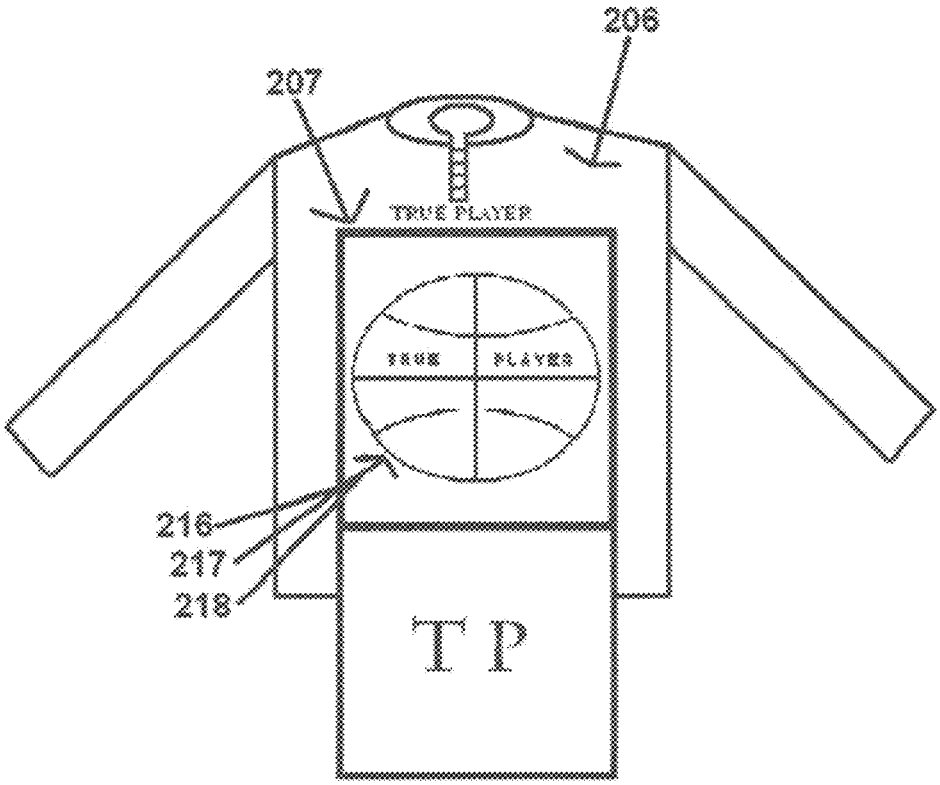
FIG. 10 shows a front view of the shirt with an interchangeable pocket in the open position with the backboard from a basketball game.

FIG. 10 is a view of the shirt 206, with the center interactive pocket 207, with the inflatable basketball backboard 216, goal 217, net 218, and inflatable ball 220, installed, not inflated, but in the storage position with interactive flat 211, in the open position.

Figure 11:
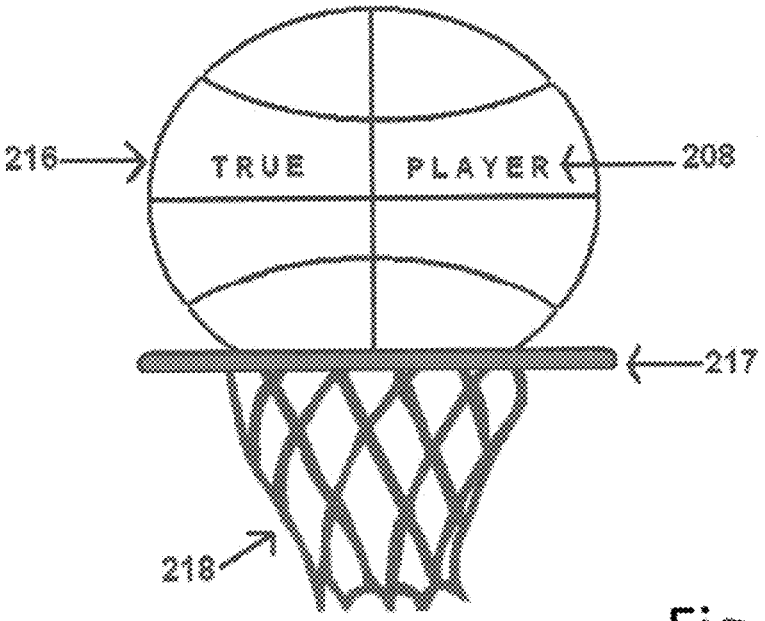
FIG. 11 shows a front view of a basketball game of the present invention with the basketball, net and goal expanded.
Figure 12:
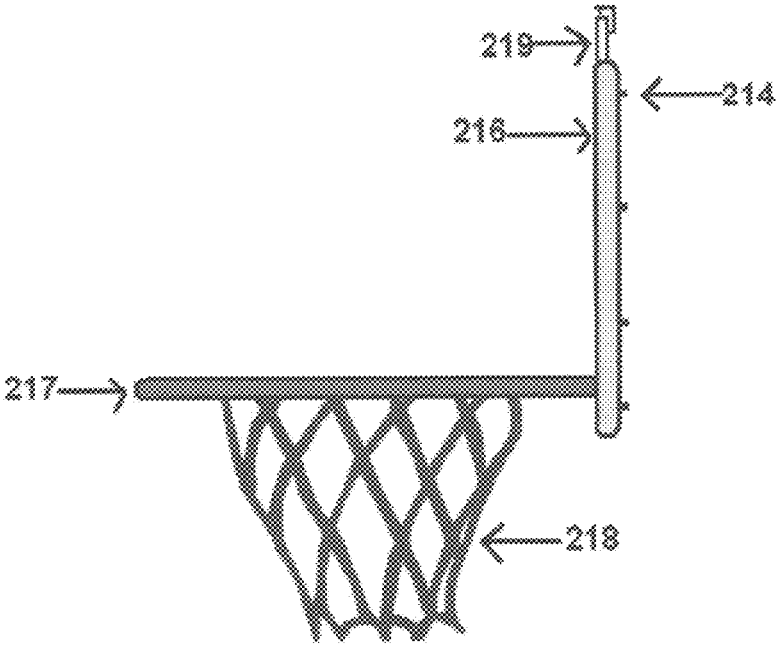
FIG. 12 shows a side view of a basketball game of the present invention with the basketball, net and goal expanded with hook and loop strips shown and the backboard stem in the open position.

FIG. 11 and FIG. 12 are views of the backboard, goal and net inflated: FIG. 11 is a front view of the inflated backboard 216, goal 217, net 218 and logo 208.

FIG. 12 is a side view of the backboard 216, goal 217 and net 218, with the inflation stem 219, in the open position after being inflated. Also on the back of the backboard 216, is a view of the Velcro (hook and loop) support strips 214.

Figure 13:
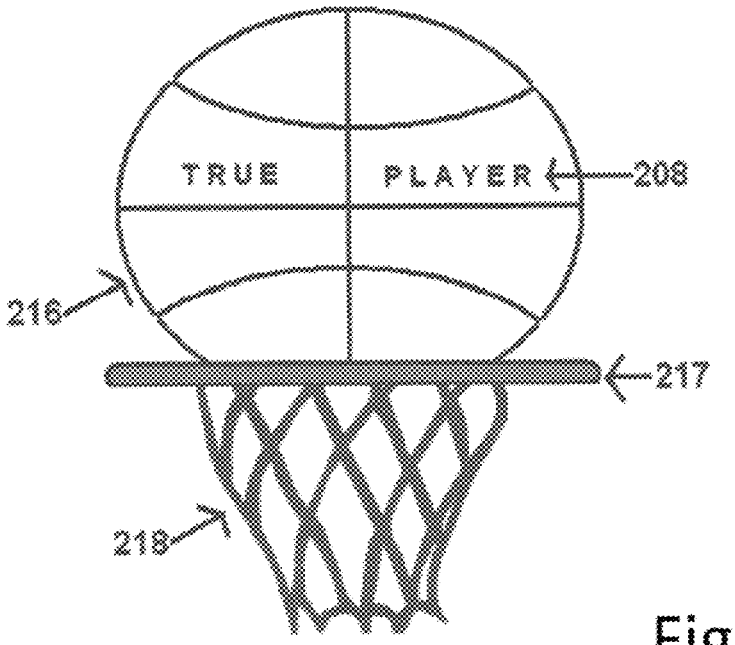
FIG. 13 shows a front view of a basketball game of the present invention with the basketball, net and goal expanded.
Figure 14:
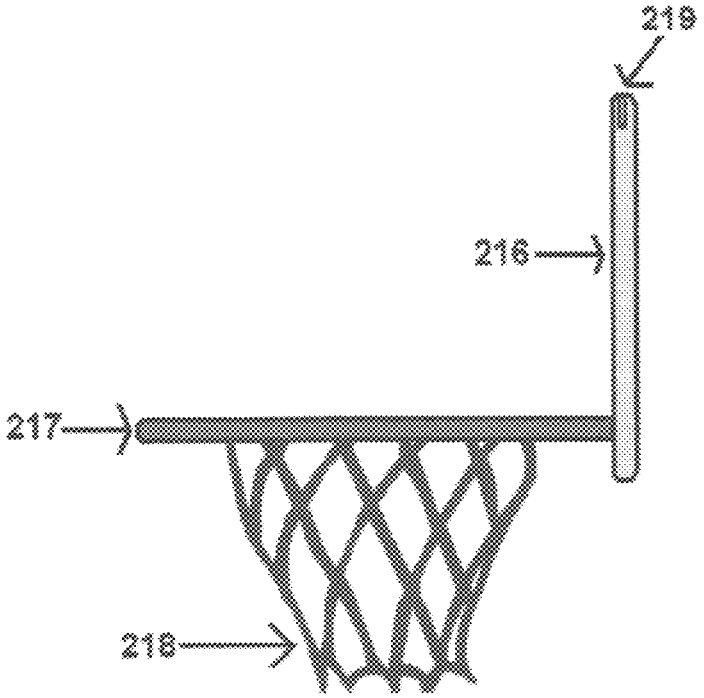
FIG. 14 shows a side view of a basketball game of the present invention with the basketball, net and goal expanded with the backboard stem in the closed position.

FIG. 13 and FIG. 14 are views of the backboard, goal and net inflated:

FIG. 13 is a front view of the inflated backboard 216, goal 217, net 218, and logo 208.

FIG. 14 is a side view of the backboard 216, goal 217, and net 218, with the inflation stem 219, in the closed position after inflating.

Figure 15:
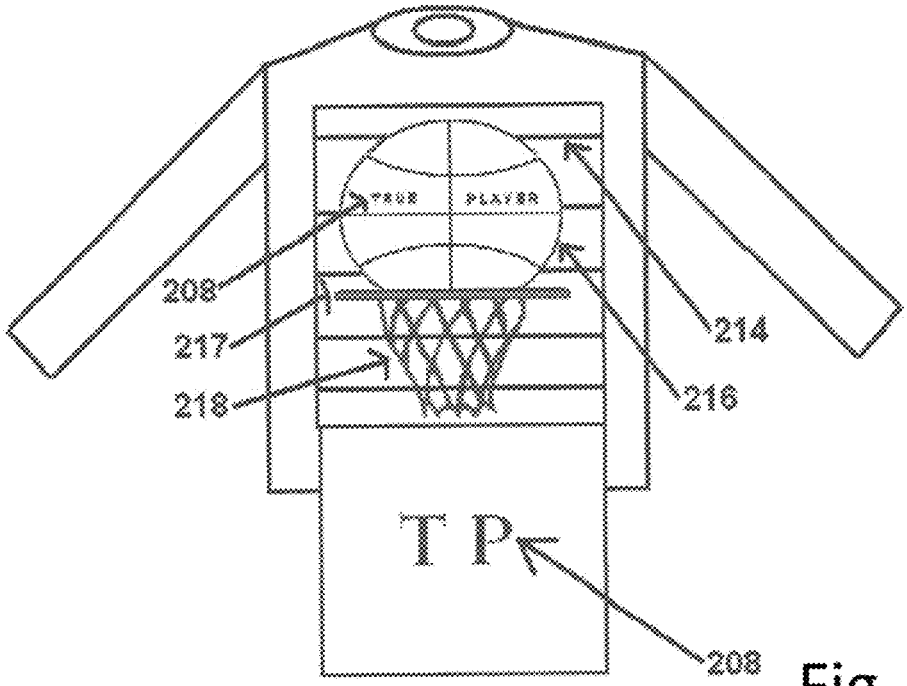
FIG. 15 shows a front view of the interactive shirt with the basketball game in the fully expanded state and hook and loop shown.

FIG. 15 shows the inflated basketball backboard 216, goal 217, net 218, and logo 208, installed and supported by the Velcro (hook and loop) support stripes 214, inside the center interactive pocket 207, and ready to be played.

Figure 16:
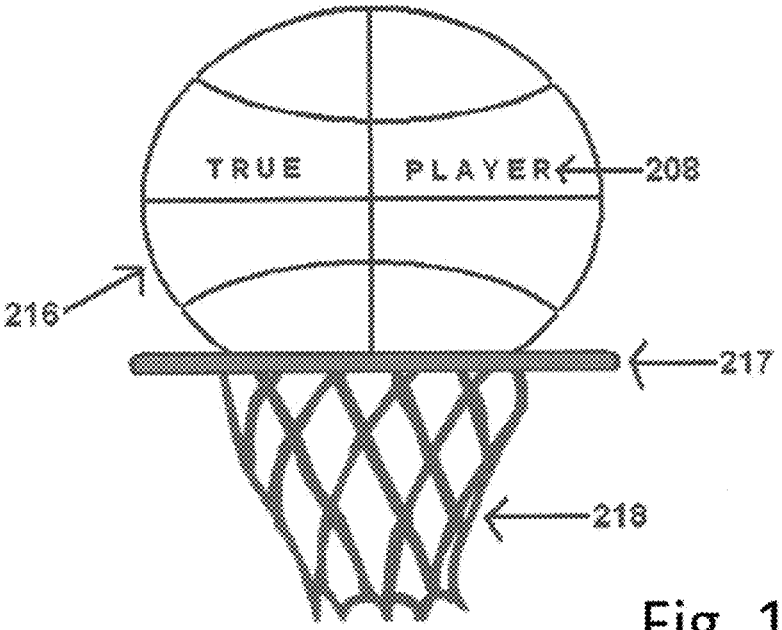
FIG. 16 shows a front view of a basketball game of the present invention with the basketball, net and goal expanded.

FIG. 16 shows the close up front view of the inflated basketball backboard 216, goal 217, net 218, and logo 208.

Figure 17:
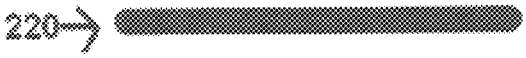
FIG. 17 shows the deflated basketball.

FIG. 17, FIG. 18, FIG. 19, and FIG. 20 show the basketball:

FIG. 17 shows the basketball 220, deflated.

Figure 18:
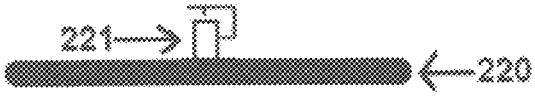
FIG. 18 shows the deflated basketball with the stem in the open position.
Figure 19:
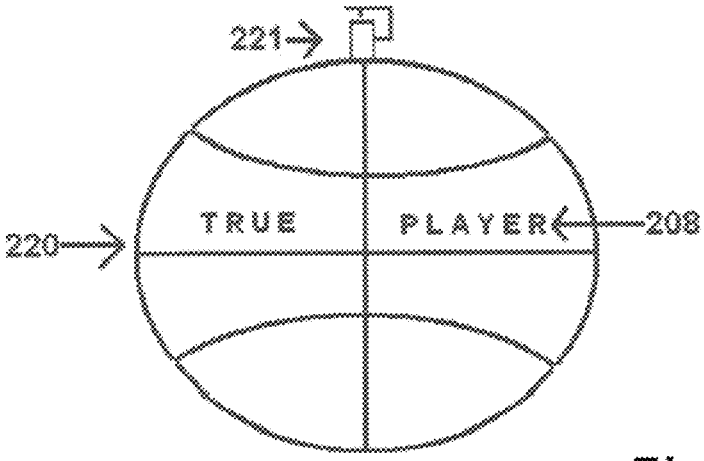
FIG. 19 shows the expanded basketball with the stem in the open position.

FIG. 18 shows basketball 220, deflated with the inflation stem 221, open. FIG. 19 shows basketball 220, inflated with the inflation stem 221, open and logo 208.

Figure 20:
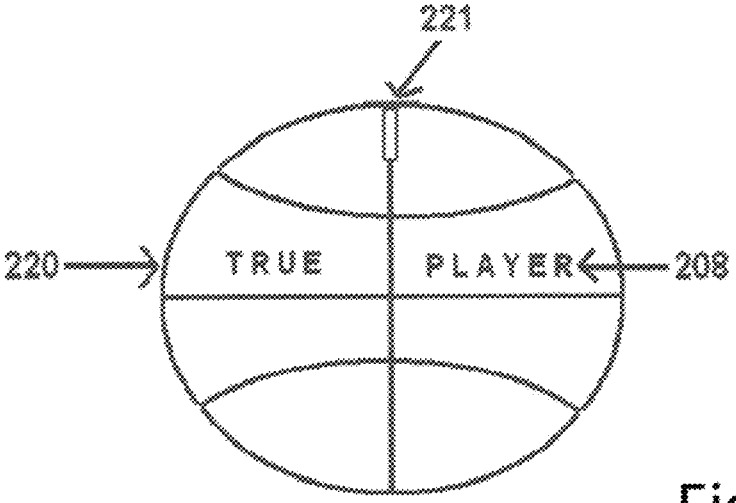
FIG. 20 shows the expanded basketball with the stem in the closed position

FIG. 20 shows basketball 220, inflated with the inflation stem 221, closed, and logo 208, and ready for playing the basketball game.

Figure 21:
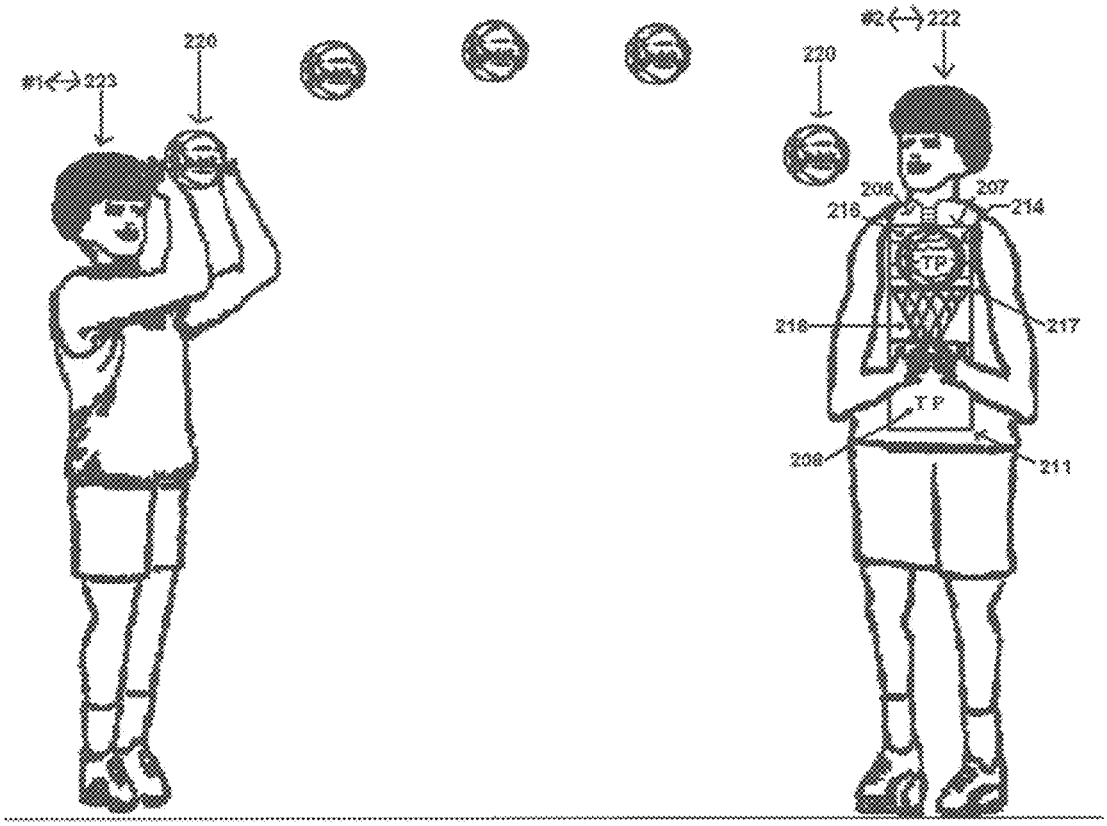
FIG. 21 shows a perspective view of two people playing the basketball game.

FIG. 21 shows the two players playing the basketball game: The players are using the interactive center pocket 207, on player's #2's 222 shirt. The inflatable basketball game, where the basketball backboard 216, goal 217, net 218, and logo 208, has been installed and supported with the Velcro (hook and loop) support strips 214, for playing. Player #1 223, is using the inflated basketball 220, to make the shot in the goal 217, on player #2's 222, shirt 206, to score points.

Figure 22:
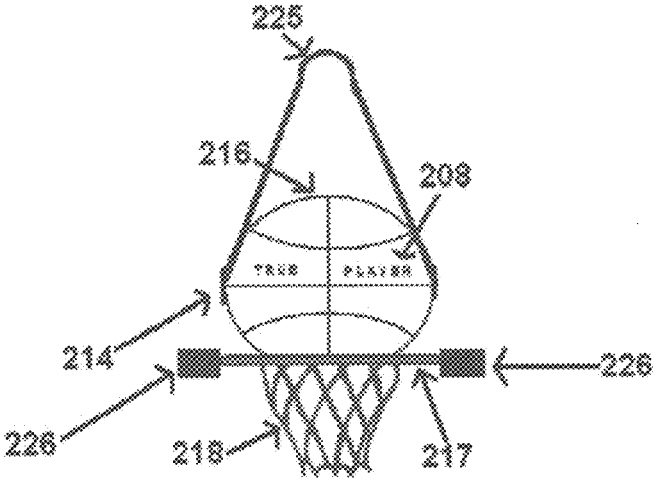
FIG. 22 shows a front view of the basketball game with the nylon neck support strap and support clips shown.
Figure 23:
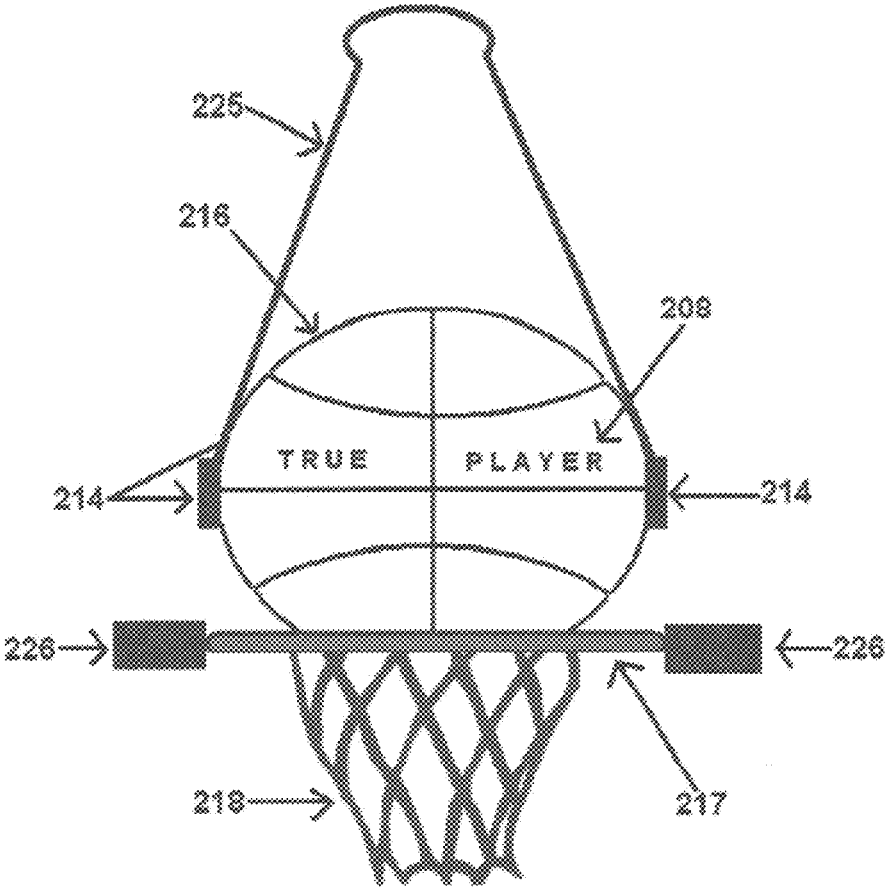
FIG. 23 shows a close up front view of the basketball game with the nylon neck support strap and support clips shown and the hook and loop support strips.

FIG. 22 and FIG. 23 show alternative methods of using the basketball game. FIG. 22 shows the fully inflated basketball backboard 216, goal 217, net 218, and logo 208, being supported with the use of a nylon neck support strap 225, which will be placed round the neck of the player. The strap is attached to the backboard 216, with a piece of Velcro 214 (hook and loop), on each side of the backboard 216, and on both sides of the Goal 217, two support clips 226, which also help keep the game supported on the shirt 206, or any type clothing. FIG. 23 shows a closer up of the fully inflated basketball backboard 216, goal 217, net 218, and logo 208, being supported with the use of a nylon neck support strap 225, which will be placed round the neck of the player. The strap is attached to the backboard 216, with a piece of Velcro 214 (hook and loop), on each side of the backboard 216, and on both sides of the Goal 217, two support clips 226, which also help keep the game supported on the shirt 206, or any type clothing.

Figure 24:
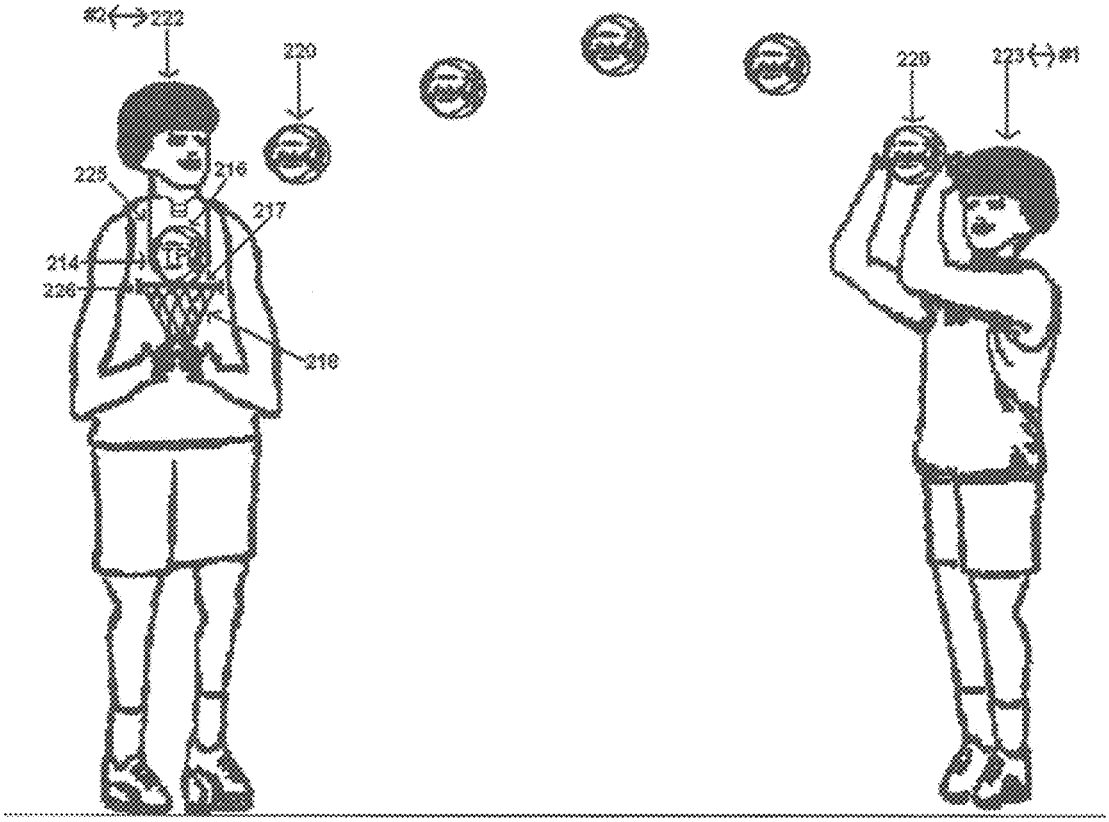
FIG. 24 shows a perspective view of two people playing the basketball game and the nylon neck support strap shown.

FIG. 24 shows the two players playing the basketball game: Player #2 222, is using the nylon neck support strap 225, around his neck, using the two support clips 226, to support the fully inflated basketball game. Player #1 223, is using the inflated basketball 220, to make the shot in the goal 217, on player #2 222, to score points in the game.

Figure 25:
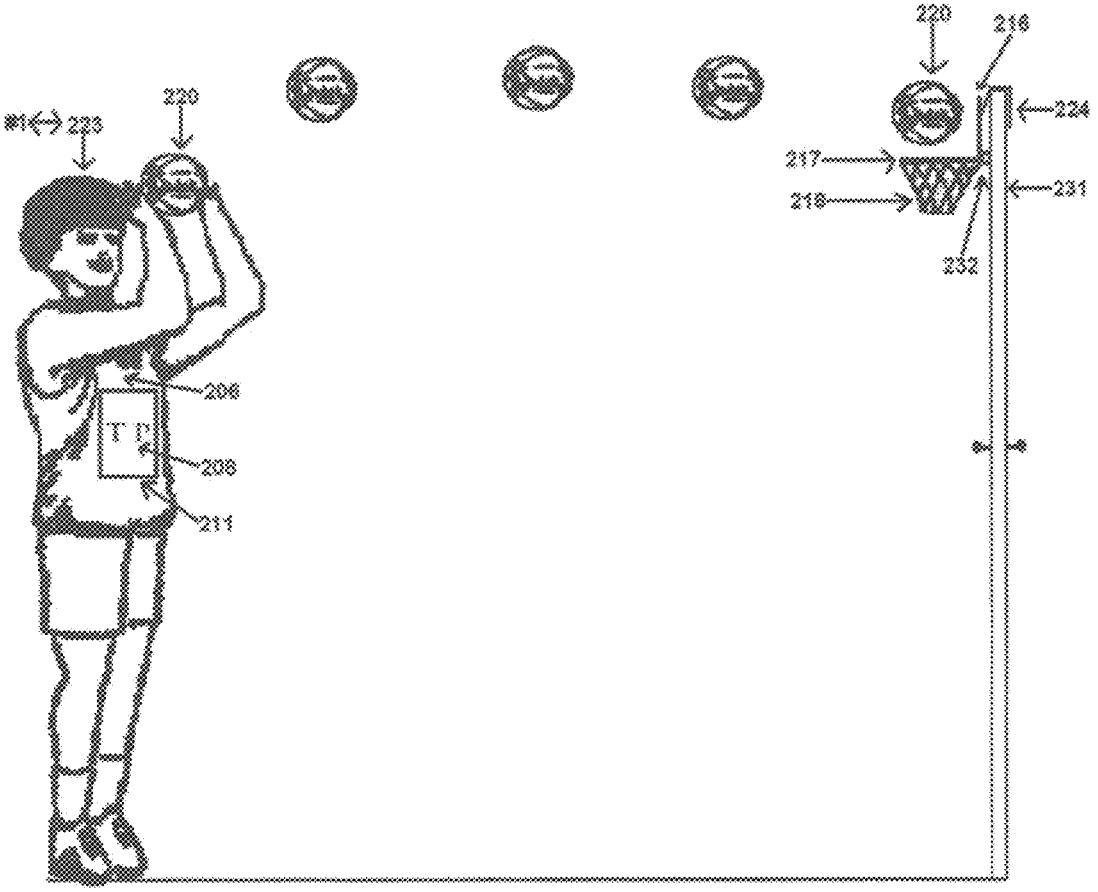
FIG. 25 shows a perspective view of another embodiment of the basketball game with the backboard, goal and net attached to a door.

FIG. 25 shows the 2nd alternative methods of using the basketball game. The player #1 223, has removed the fully inflated basketball backboard 216, goal 217, net 218, and logo 208, from the shirt 206, and the center interactive pocket 207, mounting it on the door 231, the nylon U hook 224 using Velcro (hook and loop) or another type of fasteners, and the nylon suction cups supports 232, in the back of the basketball goal 217, The interactive flap 211, has been closed on the shirt 206. The player 223, is now ready to play basketball with the inflated basketball 220. Shooting the ball 220, in the goal 217, to score points.

Figure 26:
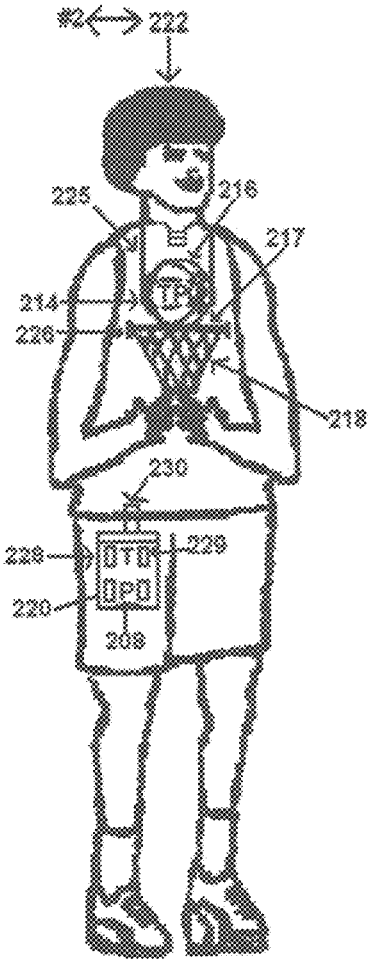
FIG. 26 shows a perspective view of a person wearing the interactive shirt with the basketball game with a carrying case on the pants evident.

FIG. 26 shows the player using the carrying case. Shows a view of player #2 222, the fully inflated basketball backboard 216, goal 217, net 218, and logo 208, being supported with the nylon neck support strap 225, and two goal support clips 226, using Velcro 214 (hook and loop). This view also shows the Basketball carrying case 228, with pants clip 230, with pockets 220, and the True Player logo 208. The deflated basketball 220, is stored inside of the case 228.

Figure 27:
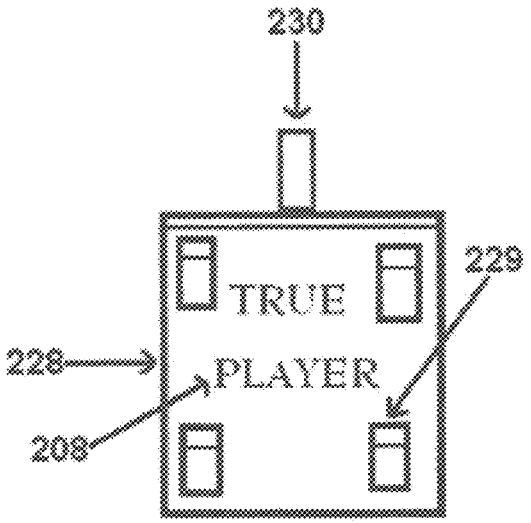
FIG. 27 shows a close up front view of a carrying case with pockets shown.
Figure 28:
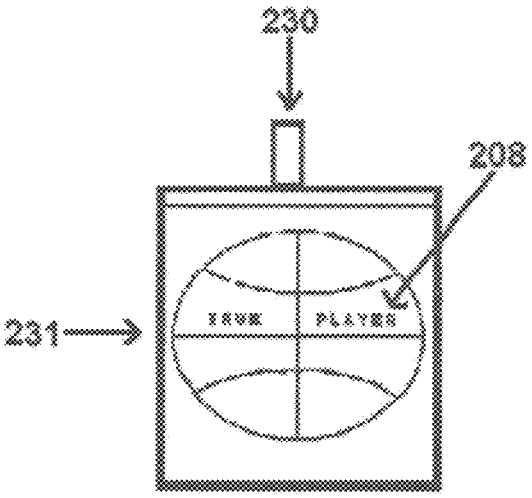
FIG. 28 shows interactive game carrying case showing a logo.

FIG. 27 and FIG. 28 show two of the many carrying cases designs. FIG. 27 shows the interactive game carrying case 228, with the pockets 229, the True Player Logo 208 and the pants clip 230. FIG. 28 shows the interactive game carrying case 228, with one of the many True Player Logo designs 208, and the pants clip 230.

FIG. 29-32 show four of many views of how the interactive center pocket will be used.

Figure 29:
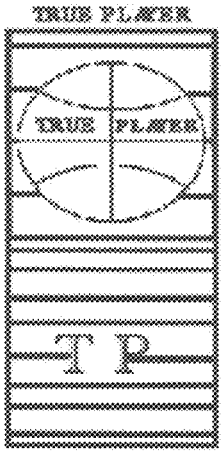
FIG. 29 shows the basketball game stored inside the interactive pocket with the flap in the open position.

FIG. 29 shows a view of the inflatable basketball game stored inside the interactive Center pocket 207, with Flap 211, in the open position with the True Player Logo 208, and Velcro (hook and loop) support strips 214, for attaching an interchangeable storage pockets 212.

Figure 30:
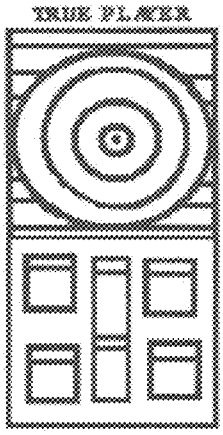
FIG. 30 shows a dart game stored inside the interactive pocket with the flap in the open position.

FIG. 30 shows a view of an inflatable dart game stored in the interactive center Pocket 207, with an interchangeable storage pocket 212, on inside Flap 211, the True Player Logo 208.

Figure 31:
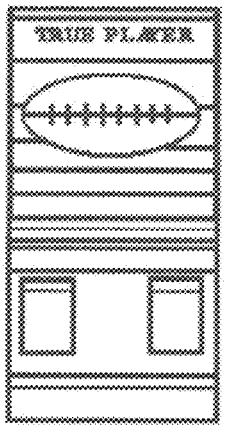
FIG. 31 shows a football game stored inside the interactive pocket with the flap in the open position.

FIG. 31 shows a view of an inflatable Football stored in the interactive center pocket 207, with an interchangeable storage pocket 212, on the inside Flap 211, and the True Player Logo 208.

Figure 32:
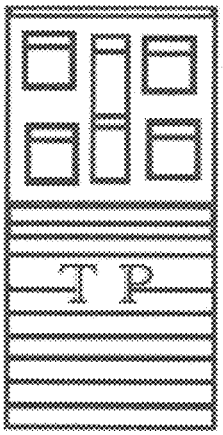
FIG. 32 shows interchangeable pockets stored inside the interactive pocket with the flap in the open position.

FIG. 32 shows a view of one of the interchangeable storage pocket 212, being stored in the interactive center pocket 207, with Velcro (hook and loop) support straps 214, on the inside of the flap 211, now allowing the flap to be used for a second set of storage pockets 212, and the True Player Logo 208.

The invention claimed is:

1. An interactive shirt comprising at least one interchangeable storage pocket, said at least one interchangeable storage pocket being able to be attached and removed from the interactive shirt wherein the interchangeable storage pocket comprises an interactive flap, said interactive flap when closed having a bottom, a top, a first side and a second side, said interactive flap being able to open in a downward direction so that when the interactive flap is open the interactive flap remains attached to the interactive pocket at the bottom of the interactive flap and when the interactive flap is open the top, the first side and the second side are not attached to the interactive pocket;

and wherein the interactive flap is of a same size as the interchangeable storage pocket, and wherein the interchangeable storage pocket comprises a game, and wherein the game is selected from the group consisting of a basketball game, a dart game, and a football game.

2. The interactive shirt of claim 1, wherein the interchangeable storage pocket is attached by hook and loop.

3. The interactive shirt of claim 2, wherein the hook and loop comprises strips that are horizontal.

4. The interactive shirt of claim 3, wherein the hook and loop comprise four strips that are horizontal.

5. The interactive shirt of claim 1, wherein the game is a basketball game comprising a net, a backboard and a goal.

6. The interactive shirt of claim 5, wherein the backboard is attached to the inside of the interactive pocket by hook and loop.

7. The interactive shirt of claim 5, wherein said basketball game further comprises a ball that is inflatable.

8. The interactive shirt of claim 7, wherein said basketball game further comprises a nylon neck strap, said nylon neck strap being designed to fit around a player's neck to provide support to the backboard and goal.

9. The interactive shirt of claim 8, wherein said basketball game further comprises a basketball carrying case, said carrying case designed to clip to pants via a pant's clip.

10. The interactive shirt of claim 1, wherein said game further comprises a game carrying case, said game carrying case designed to clip to pants via a pant's clip.

11. The interactive shirt of claim 2, said interchangeable pocket being of a size and shape so that the interchangeable pocket is able to store items, said items being one or more members selected from the group consisting of a cell phone, a wallet, car keys, eye glasses and makeup.

12. The interactive shirt of claim 2, wherein the interchangeable pocket is present on a sleeve of said shirt.

13. The interactive shirt of claim 1, wherein there are a plurality of interchangeable pockets.

14. The interactive shirt of claim 1, wherein the interchangeable storage pocket comprises an interactive flap, said interactive flap having a bottom, a top, a first side and a second side, said interactive flap being able to open so that the interactive flap remains attached to the interactive pocket at the bottom of the interactive flap and when the interactive flap is open the top, the first side and the second side are not attached to the interactive pocket; and said interactive flap being able to close so that the interactive flap remains attached to the interactive pocket at the bottom and the top, the first side and the second side are also attached to the interactive pocket when closed.

15. The interactive shirt of claim 14, wherein the game comprises a basketball game that comprises a goal, a net and a backboard, and the interactive pocket comprises and is able to store the basketball game when closed and the backboard can be attached to the interactive shirt by hook and loop or to a door.

16. The interactive shirt of claim 1, further comprising a logo that is visible on the interactive flap.

* * * * *